US005129651A

United States Patent [19]

Tobias, Jr.

[11] Patent Number: 5,129,651

[45] Date of Patent: Jul. 14, 1992

[54] BASEBALL BOARD GAME AND METHOD OF PLAY

[76] Inventor: Tomas T. Tobias, Jr., 4 A Boyd Ct., Jersey City, N.J. 07304

[21] Appl. No.: 509,984

[22] Filed: Apr. 16, 1990

[51] Int. Cl.[5] ..... A63F 7/06

[52] U.S. Cl. ..... 273/93 R; 273/244

[58] Field of Search ..... 273/93 R, 93 C, 244, 273/243, 277, 298, 259, 88; D21/14, 21, 25, 27, 28

[56] References Cited

U.S. PATENT DOCUMENTS

| | | | |
|---|---|---|---|
| D. 163,325 | 5/1951 | Robbins | 273/243 X |
| 1,084,618 | 1/1914 | Elliott | 273/93 R |
| 1,324,037 | 12/1919 | De Tamble | 273/93 R |
| 1,532,066 | 3/1925 | O'Conner | 273/93 R |
| 1,544,308 | 6/1925 | Gelpi | 273/93 R |
| 2,434,195 | 1/1948 | Cantor | 273/88 |
| 2,629,597 | 2/1953 | Lenit | 273/93 R |
| 2,769,639 | 11/1956 | Seale | 273/93 R |
| 2,886,319 | 5/1959 | Henderson | 273/93 R |
| 3,445,115 | 5/1969 | Hunter | 273/243 |
| 3,941,386 | 3/1976 | Nelson | 273/244 X |
| 4,261,569 | 4/1981 | Frohlich | 273/93 |
| 4,452,453 | 6/1984 | Daley et al. | 273/93 R |
| 4,657,254 | 4/1987 | Renner | 273/88 |
| 4,708,344 | 11/1987 | Wyatt | 273/93 R |
| 4,776,593 | 10/1988 | DiPersio et al. | 273/93 C |

*Primary Examiner*—William H. Grieb
*Assistant Examiner*—Sebastiano Passaniti
*Attorney, Agent, or Firm*—Irwin Ostroff

[57] ABSTRACT

A baseball board game comprising a board having a baseball field depicted thereon. The field is divided into nine square areas each designated by a single digit number. Each of the square areas is divided into thirty six small squares each designated by a two digit number. Several different types of pitches are listed on the board and each has thereunder a group of two digit numbers. Several groups of hitting two digit hitting numbers are listed on the board, and a group of field two digit numbers are arranged in a plurality of rows on the board. Each row of the field numbers is headed by a different single digit number corresponding to the number of large square areas on the board. The digits of each of the two digit numbers is from "1" to "6", and the second digit of each of the numbers is of a color different from that of the first digit. A plurality of markers are provided to indicate the members of each of the teams and a separate marker is used to indicate the ball. Three sets of six sided dice are used with one die of each set being of a color different from that of the other die and the colors of the dice corresponding to the colors of the digits of the two digit numbers.

18 Claims, 2 Drawing Sheets

48a

PLAYERS BATTING ORDER AND STATISTICS

TEAM _____

VS. _____

GAME SERIES _____

| ORDER | NAME OF PLAYER | POSITION | | AB | 1B | 2B | 3B | HR | SO | RBI | BA |
|---|---|---|---|---|---|---|---|---|---|---|---|
| 1 | | | R/L | | | | | | | | |
| 2 | | | R/L | | | | | | | | |
| 3 | | | R/L | | | | | | | | |
| 4 | | | R/L | | | | | | | | |
| 5 | | | R/L | | | | | | | | |
| 6 | | | R/L | | | | | | | | |
| 7 | | | R/L | | | | | | | | |
| 8 | | | R/L | | | | | | | | |
| 9 | | | R/L | | | | | | | | |
| 10 | | | R/L | | | | | | | | |

AB-AT BAT
1B-SINGLE
2B-DOUBLE
3B-TRIPLE
HR-HOME RUN
SO-STRIKE OUT
RBI-RUNS BATTED IN
BA-BATTING AVERAGE

FIG. 3

BASEBALL BOARD GAME AND METHOD OF PLAY

FIELD OF THE INVENTION

The present invention relates to a board game for playing the game of baseball, and, more particularly, to a baseball board game which provides the players with the opportunity to make strategy decisions throughout the game, both on offense and defense, so as to closely follow the actual play of baseball.

BACKGROUND OF THE INVENTION

A number of board games have been designed for the simulation of the game of baseball. However, in most of these board games the action taken by the players relies mainly on chance, such as by the throw of dice, the spin of a wheel, or the taking of a card indicating the play. Thus, none of these games actually duplicates much of the games possibilities and excitement that can occur in the field of play of an actual game. For example, in a real game of baseball a pitcher has the option of delivering various types of pitches which can result in the call of either a ball or a strike, or which can be hit by the batter. Also, with a man on base, the pitcher has the option of throwing the ball to the base in an attempt to catch the runner off base. A batter has the option of allowing a pitched ball to pass or to swing at the ball. If the batter swings he can miss the ball for a strike, or hit the ball. If the batter hits the ball, he can hit it on the ground or in the air and can attempt to hit it to a desired part of the field. Also, the batter has the option of attempting to bunt the ball. The team on defense has the option of where to place the men in the field based on the batters ability. Also, when a ball is hit, the fielders can either catch or not catch the ball, and once caught, the ball may have to be thrown to a particular base in order to achieve an out.

In order to more exactly duplicate the actual play of the game of baseball, it would be desirable to have a board game which allows the players to make all or most of these decisions which occur in an actual game and to limit the actions made by chance, such as by the throw of dice.

SUMMARY OF THE INVENTION

Viewed from one aspect the present invention is directed to a game for playing the game of baseball. The game comprises a board having an area thereon representing a baseball field, said area being divided into a plurality of first sub-areas each represented by a different one of a first group of reference characters. Each of the first sub-areas is divided into a plurality of smaller second sub-areas with each second sub-area having therein a reference character of a second group of reference characters. The game further comprises a first plurality of markers representing the players of each team, a separate marker representing a baseball, and random selection means comprising the second group of reference characters for determining various plays of the game.

Viewed from another aspect the present invention is directed to a baseball board game which comprises a board having a playing field depicted thereon. The playing field is divided into a plurality of sub-areas each indicated by digits of different colors representing the digits appearing on different colored dice. Some of the dice are used to determine offense plays and some for defensive plays. The board also contains indicia indicating different offensive and defensive plays that can be chosen by the players and the results of each of the choices resulting from the throw of a particular colored die. For each batter, the player on defense makes choices as the type of pitch being attempted by the pitcher and the player on offense makes a choice as to whether or not to swing at the pitch. The throw of the particular colored die determines the success of the pitch and the decision of the batter. If the batter hits the pitch, the throw of a die determines where and how the ball is hit, whether or not the ball is caught and if caught whether it reaches the appropriate base prior to the runner.

More particularly, the baseball game of the present invention comprises a board having an area representing a baseball field depicted thereon. The field is divided into a plurality of first sub-areas each represented by a different one of a first group of reference characters. Each of the first sub-areas is divided into a plurality of smaller second sub-areas each having therein reference characters of a second group of reference characters. The game also includes a plurality of markers for indicating the different players of the teams and a ball, and a random selection means for selecting the reference characters which determine various plays of the game.

The game is typically played by two players, one on offense and the other on defense. The player on offense selects a desired type of pitch to be thrown by a pitcher and operates the random selection means to determine whether the pitch is a strike or ball. The player on offense makes a determination as to whether or not to swing at the pitch. If the player on offense decides to swing, he operates the random selection means to determine whether or not the player at bat hit the ball. If it is determined that the player at bat hit the ball, the player on offense operates the random selection means to determine whether the ball is a fly ball or a ground ball and to which field the ball is hit. If it is determined that the player at bat hit the ball, the player on defense operates the random selection means to determine whether or not the ball is caught. If it is determined that the player at bat hit the ball on the ground, the ball and the player on offense move over a grid of sub-areas on the board to determine whether the player on offense is thrown out at a base.

The invention will be better understood from the following more detailed description taken with accompanying drawings.

BRIEF DESCRIPTION OF THE DRAWING

FIG. 3 is a plan view of a form for listing the players on each team.

It should be understood that the drawings are not necessarily to scale.

DETAILED DESCRIPTION

Figure 1:
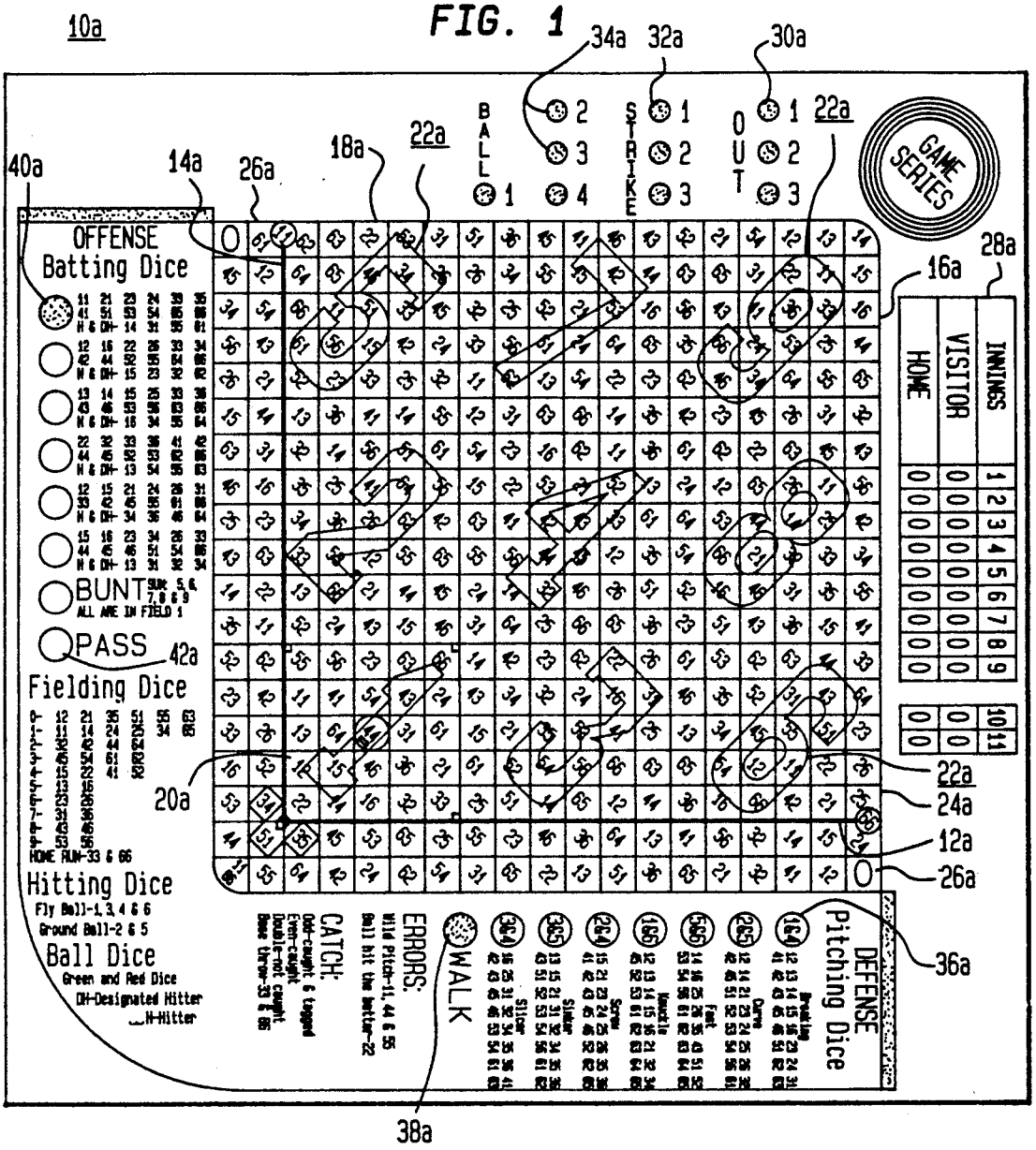
FIG. 1 is a plan view of the board of the baseball game of the present invention.

Referring to FIG. 1, there is shown a plan view of a board 10*a* of a baseball game of the present invention. All reference numbers are shown with an "a" thereafter, whereas numbers on the board 10*a* do not have an "a" thereafter. The board 10*a* is preferably of a rigid material and may be made in a single piece or a plurality of pieces hingedly connected together. On the board 10a is depicted a baseball field having right and left foul lines 12a and 14a, right and left outfield lines 16a and 18a and an infield diamond 20a. The field is divided into a plurality of first sub-areas 22a, which are shown to be substantially square areas of uniform size. As shown, there is preferably nine such areas 22a arranged in rows and columns of three. The areas 22a which are along the foul lines 12a and 14a extend across the foul lines 12a and 14a to indicate foul areas of the field. Each of the areas 22a is represented by a different one of a first group of reference characters, shown as a large single digit number, 1 to 9, to identify the particular area with the numbers being randomly placed on the areas 22a. The infield diamond 20a is positioned entirely in the area 22a at the intersection of the foul lines 12a and 14a.

Each area 22a is divided into a plurality of smaller second sub-areas 24a, shown as substantially square areas of uniform size. Two of the second sub-areas 24a (i.e., the areas 24a at the lower left near the word "Hitting Dice" and at the upper right near the words "Game Series") have round corners. As shown, each area 22a contains thirty-six of the smaller areas 24a which are arranged in rows and columns of six. The areas 22a along the foul lines 12a and 14a have one row or column of the smaller area 24a outside the respective foul line 12a or 14a. In each of the areas 22a, each of the small areas 24a contains a reference character of a second group of reference characters, which are shown to be two digit numbers, to identify the area. Each of the digits is from "1" to "6" and the squares 24a in each area 22a contain every combination of the numbers. The first digit of each number is typically of one color, such as green and the second digit of each number is typically of a different color, such as red. Thus, each square 24a contains a two digit number, the first being green and the second being red, and the digits being from "1" to "6". The numbers are randomly placed in the squares 24a in each area 22a. However, as can be seen in the drawing and for reasons which will be explained later with regard to the play of the game, in some of the areas, the numbers starting with the same first digit are arranged together. For example, in the area 22a indicated by the large digit "9", the numbers having the first digit "1" are arranged together, and in the area 22a indicated by the digit "8", the numbers having the first digit "3" are arranged together. Along the squares 24a which are along the outside of the foul lines 12a and 14a is at least one additional row of small squares 26a. At the end of each of the rows of squares 26a is a "0" indicating that these are foul squares. Each of the squares 26a also contains a two digit number with each digit being between "1" and "6", and with the first digit being green in color and the second digit being red in color. As shown, the square 26a directly behind the home plate contains two two digit numbers, "11" and "66", which are used in the play of the game.

Along the right outfield line 16a is a score board 28a indicating the innings and the score for each inning for each team. Along the left outfield line 18a are three circles 30a indicating the number of outs, three circles 32a indicating the number of strikes, and four circles 34a indicating the number of balls. Some type of marker (not shown) is typically provided and is placed on the circles 30a, 32a and 34a to indicate the appropriate number of each during the play of a baseball game using board 10a.

Along the first base foul line 12a is indicia indicating types of defense plays. For pitching there is listed various types of pitches that the pitcher can make. Seven different types of known and generally used pitches are listed. Under each type of pitch is listed a series of two digit numbers with each digit being between "1" and "6". The first digit of each number is in one color, such as the color red, and the second digit is in a different color, such as the color black. These numbers indicate upon the throw of a pair of dice whether the pitch thrown is a strike. There are sixteen numbers listed under each pitch. Since there are thirty six possible numbers which can be obtained upon the throw of a pair of dice or the operation of any other type of random selection means, the chances of obtaining a strike are slightly less than 50%.

Although the numbers listed for each pitch are randomly picked, there are more numbers starting with two different first digits than for the other four digits. For example, the breaking ball has five numbers starting with the digit "1" and five numbers starting with the digit "4". The other numbers start with other digits. The curve ball pitch has five numbers starting with the digit "2" and five numbers starting with the digit "5". Likewise each of the other pitches has five numbers starting with each of two different first digits. At the front end of each of the lists of numbers is a circle 36a having therein the two major first digits for that particular pitch. A marker (not shown) is provided for the player on defense to place on a circle 36a to indicate the type of pitch he wants his pitcher to make.

Below the types of pitches is a circle 38a indicating a "Walk". Below that are types of errors and the numbers which will provide such errors. For example, double "1", "4" or "5" provides a wild pitch and double "2" provides a batter hit by the ball. Below the pitching indicators are indicators for fielding. An odd number indicates caught and batter tagged out for an infield ground ball, an even number indicates that the ball is caught by a fielder and a double number indicates that the ball was not caught. Below the fielding is an indicator to show that if the pitcher throws a double "3" or "6" he has thrown the ball to a base in an attempt to catch a runner off base.

Along the third base foul line 14a, there is indicia indicating offense action. Under the heading "BATTING DICE" there are six groups of two digit numbers. Each digit is from "1" to "6" with the first digit of each number being of one color, for example, the color blue, and the second digit being of a different color, for example black. These numbers are used to determine when a batter hits a ball. There are twelve basic numbers in each group which provides each batter with a 33% chance to hit the ball. There are an additional four numbers next to the heading "H&DH". These are also used when a batter indicated by the player as a major batter (H) or as a designated hitter (DH) under American League rules. The additional numbers for these types of batters increases their chances of hitting the ball to 44%. The numbers in each group are different and are randomly selected. At the side of each group of numbers is a circle 40a on which the player on offense places a marker to indicate which group of numbers he intends to use for a particular batter. Below the hitting numbers is a circle 42a next to the word "PASS". The player on offense places his marker in the PASS circle 42a if he intends to take a pitch. There are times when a batter takes less than a full swing and pokes the ball between infielders. This batting strategy is a bunt or place batting. Below the hitting numbers are five single digit numbers next to the word "BUNT". These numbers are the sum of the blue and black dice. If any of these numbers appears at the throw of the blue and black dice, the ball lands in the field "1" (the infield) only. The red and green dice is thrown to find the exact place the ball lands. It is a drop ball. This means the ball does not roll after it hits the particular portion of the field designated by the numbers on the dice. If the ball lands at the exact square of any fielder and is caught, the batter is out.

Below the hitting numbers are fielding numbers under the title "FIELDING DICE". There are ten rows of two digit numbers headed by a single digit number from 0 to 9. Each of the digits of the two digit numbers is from "1" to "6" with the first digit being of one color, such as black, and the second digit being of a different color, such as blue. There are 34 two digit numbers randomly placed in the rows. As will be explained later, these numbers are used to indicate which square 22*a* of the field a ball is hit by the single digit number at the beginning of each row. As indicated below these numbers a double "3" or "6" indicates a home run. Under the heading "Hitting Dice" there is an indication that a fly ball is obtained by a "1", "3", "4", or "6", and a ground ball is obtained by a "2" or "5". These numbers are in a color, such as blue, to indicate that they are obtained by the throw of a blue colored die.

Figure 2:
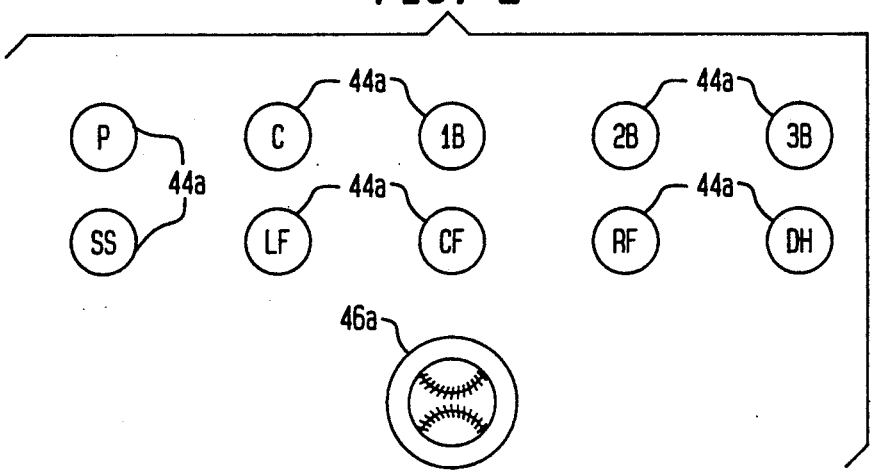
FIG. 2 is a plan view of the various discs used as markers to indicate the players and the ball.

As shown in FIG. 2, each player has ten markers 44*a*, in the form of a disc, to indicate the players on his team. Each marker 44*a* has an indicia thereon to indicate the position of the player. For example, "C" for catcher, "P" for pitcher, "1B" for first baseman, etc. One of the markers 44*a* has the indicia "DH" thereon for the designated hitter when using American League rules. The markers 44*a* for one player are of a different color than those of the other player to differentiate the two teams. A marker 46*a*, in the form of a disc, has a picture of a ball thereon and is used to designate the baseball. Although not shown, the game also includes three pairs of six sided dice with each die having the digits "1" to "6" on its sides. One die of each pair is of a color different from that of the other die, and the colors match the colors of the various digits on the board 10*a* depending on the purpose of the pair of dice. For example, the die of the pair of dice used for pitching are red and black, the die of the pair of dice used for batting are blue and black, and the die of the pair of dice used for fielding are black and blue.

To play the baseball game of the present invention, the players select a known ball club or make up a ball club of their own choice. On a piece of paper they write down the batting order they desire to use. FIG. 3 shows a form 48*a* that is useful for this purpose. The form 48*a* not only lists the names of the players, in a selected batting order, but also provides for listing of various statistics regarding each player. For example, the players position, whether he is right or left hand hitter, the number of various types of hits he has made, the number of his strike outs, the number of runs he had batted in and an overall batting average. When a team is on offense the markers 44*a* for the players are arranged in the batting order on a dugout stand. Each player throws a pair of dice to determine who goes first. The one throwing the higher sum of the two dice goes first and is the Visiting team. If the game is being played with National League teams of the players own creation, the team is allowed two hitters(H) and two left handed players. If playing with an actual team, the team is allowed two hitters(H) and as many left handed players as the team actually has. If playing with American League teams of the players own creation, each team is allowed one hitter(H), one designated hitter(DH) who bats for the pitcher, and two left handed players. If playing with actual teams, each team is allowed one hitter(H), one designated hitter(DH) and as many left handed players as are actually on the team. The players can decide to play any number of innings.

The player who is first, the Visiting team, places the marker 44*a* for his first batter in the square 24 adjacent the home plate on the appropriate side of the home plate depending on whether the batter is right or left handed. For example, a right handed batter would be placed in square indicated 34 and a left handed batter would be placed in square indicated 35. The player on defense would place the player markers 44*a* of his team in their appropriate places in the field. The ball marker 46*a* would be placed on the pitching mound.

The red and black dice are the pitching dice which determine whether a pitch is a strike, ball, error or a base throw. The player on defense places a marker on one of the pitching circles 36*a* to indicate the type of pitch he wants the pitcher to throw. He then throws one of the pitching die first to indicate the ball in flight, and then later throws the other pitching die to indicate the ball reaching home plate and being caught by the catcher if the ball is not hit. If desired, a small box may be used to throw the dice in to achieve a more active tumbling of the dice. When the first pitching die is thrown, the player on offense decides whether he wants to swing at the ball or allow the ball to pass depending on the number of two digit numbers listed under the particular pitch that has the digit thrown. For example, if the pitcher is throwing a breaking ball and the red die is thrown first and comes up with a "1" or "4", there are a large number of the numbers having this first digit. Thus, there is a greater chance that the throw of the second die will indicate a strike so that the batter may want to swing at the ball. However, if the red die comes up with a different digit, there are fewer numbers having the other first digits, so that the batter may decide not to swing but allow the ball to pass.

If the batter decides to allow the pitch to pass, he places a marker on the PASS circle 42*a*. The pitcher than throws the other die. If the number of the second die is listed with the number of the first thrown die then the pitch is a strike. However, if the number of the second die is not listed, the pitch is a ball. For each such pitch, markers are placed on the appropriate ball and strike circles 34*a* and 32*a*. The pitcher continues to pitch until the batter either strikes out, is walked or hits the ball. The pitcher can change the type of pitch thrown for each pitch and the batter has the option to swing or pass for each pitch.

Each pitch is caught by the catcher, except when "11", "44" or "55" is thrown. A "11" indicates that a ball is thrown above the catcher's head and is not caught. A "44" indicates a ball thrown to the far left of the catcher and is not caught, and a "55" indicates a ball thrown to the far right of the catcher and not caught. A "22" indicates that the batter is hit by the ball and takes a walk.

If there is a runner on base, the runner can have a one square lead from the corresponding base. However, when the pitcher throws a "33" or "66" he can throw the ball to the base in an attempt to catch the runner off base. To find out whether the ball is caught, the red and black dice are thrown at the same time by the player on defense. If the sum of the two numbers is ODD, this means that the ball is caught and the runner is tagged and out. If the sum of the numbers is EVEN, the ball is caught but the runner is not tagged, and is safe. When the dice come out in a double number, the ball is not caught and should be moved to another square 24a. The offense throws one dice to determine the number of the squares 24a the ball should be moved. As in a real ball game, a ball can only move forward or sideways, never backward. The runner can run to the next base if he chooses.

The blue and black dice are the batting dice. After the pitcher throws the first die of a pitch, if the batter decides to swing at the pitch he places a marker on one of the batting circles 40a to indicate the batting numbers he desires to use. He then throws the blue or black die. This first die represents the batter who starts to swing the bat. However, he may elect not to continue the swing by not throwing the second die. After the batter throws the first die, such as the blue die, the pitcher then throws his second die. If the two numbers thrown by the pitcher are not in the list for the indicated pitch, the batter can decide not to continue his swing and allow the call of a ball. However, if the two numbers thrown by the pitcher are on the list, this is a strike. If the two numbers thrown by the batter are in the group he elected, it constitutes a hit. If the two numbers are not in the list, it is a strike. If the batter is designated as a hitter (H) or a designated hitter (DH) the additional four numbers are considered along with the initial 12 numbers.

The throw of a "33" or "66" indicates a home run. The green and red dice are then thrown to determine which outside field the ball landed. After throwing a "33", if the throw of the green and red dice results in either a "11" or "66", this means that the ball hit a foul pole and is considered a fair ball. However, after throwing a "66", if the throw of the green and red dice results in a "11" or "66", this means that the ball passed outside the foul poles and is a foul ball.

When the throw of the blue and black dice indicate a hit, the digits of the two dice are read with the black die digit first and the blue die digit second to determine what field the hit is made to. The blue digit, black digit number is looked for under the heading "Fielding Dice" to see what row the number is in. The single digit at the beginning of the row indicates that square 22a of the field that the hit was made to. For example, if the blue die indicated a "2" and the black die indicated a "4", "24" is in the row for the digit "1". This indicates that the ball is hit into the infield square 22a indicated by the digit "1". If the two digit number is in the "0" row, the hit is a foul ball since it fell into the "0" area outside the foul lines 12a and 14a.

After a ball is hit and the field to which the ball is hit is determined, the blue die is used to determine whether the ball is hit in the air or on the ground. As indicated under the heading "Hitting Dice", if the hitter throws a "1", "3", "4" or "6", the ball is a fly ball. If the hitter throws a "2" or "5" the ball is a ground ball. The green and red dice, referred to as the "ball dice", are then used to determine the exact location on the field that the ball lands. The two digit number given by reading the red die first and then the green die indicates the small square 24a that the ball lands in. Thus, if the throw of the red and green dice provides a reading of "34", when the ball is hit the number "34" therein in the square "1".

If the ball is hit in the air as a fly as indicated by the throw of the blue die, and there is a defensive player located within five small squares 24a of the square that the ball lands in, the ball can be caught and the batter is out. If the ball is a ground ball, the ball can be caught but the runner is not out. The ball must then be thrown to a base to get the batter out. The runner moves first and then the ball. Since a thrown ball normally goes faster than a runner, the ball moves five spaces for every one space of the runner up to ten spaces of the ball. After that the ball moves one space for every space of the runner. If the ball reaches a base before the runner and is caught by the baseman, the runner is out. A catch is determined by a throw of two dice. All baseball rules are followed in this game so that after three outs the players change from defense to offense.

Thus, there is provided by the baseball board game of the present invention, a baseball game that more closely resembles an actual game in that each player makes choices on both offense and defense. On defense, the pitcher must decide what type of pitch to throw, and on offense the batter must decide on whether to swing or allow the ball to pass. These decisions then determine what action follows based on the throw of dice. When a ball is hit, whether the hit is an out or a base hit is determined by whether the ball is hit in the air or on the ground and the location that the ball is hit to. On a ground ball, the defense has an opportunity to throw the runner out in a manner similar to what occurs in a real game. Thus, the baseball game of the present invention closely resembles the actual play of baseball.

It is to be appreciated and understood that the specific embodiments of the invention are merely illustrative of the general principles of the invention. Various modifications may be made consistent with the principles set forth. For example, the digits of the two digit numbers can be colors other than those specified as long as the various dice are of colors corresponding to those on the board. Still further, the position of the various two digit numbers in the squares 24a can be varied from those shown in the drawing, and the various two digit numbers listed under the types of pitches and the hitting can be varied. Still further, although the first and second sub-areas 22a and 24a are shown to be square, they can be of any other shape which can be fit into a baseball field, such as rectangular, triangular or round. Furthermore, there can be fewer or greater number of each of the first and second sub-areas 22a and 24a depending on the number of reference characters on the random selection means used. Still further, although the random selection means has been described as being six sided dice, it can be other types of radon selection means such as spin mechanisms, cards or the like. Still further, the random selection means can have more than six reference numbers. The number of reference numbers on the random selection means determine the number of first and second sub-areas 22a and 24a. Still further, instead of using numbers as the reference characters on the random selection means and in the sub-areas 22a and 24a, other types of reference characters can be used, such as letters, figures, symbols and the like. Instead of using digits of different colors, reference characters which distinguish from each other in any respect can be used. For example, one reference character can be an Arabic number and the other a Roman number. Furthermore, each of the sub-areas 24a of a common area 22a can have all of the areas 24a therein which start with the same first digit placed in a common portion of the area 22a thereof.

What is claimed is:

1. A game for playing the game of baseball by teams comprising:

a board having an area defined thereon representing a baseball field, said area being divided into a plurality of first sub-areas each represented by a different one of a first group of reference characters imprinted thereon;

each of said first sub-areas being divided into a plurality of smaller second sub-areas with each second sub-area having imprinted thereon a reference character of a second group of reference characters;

a first plurality of markers representing a plurality of players of each team;

a separate marker representing a baseball; and random selection means comprising the second group of reference characters for determining various plays of the game.

2. A game for playing the game of baseball by teams comprising:

a board having an area defined thereon representing a baseball field comprising an infield and an outfield, said areas being divided into a plurality of first sub-areas each represented by a different one of a first group of reference characters imprinted thereon;

each of said sub-areas being divided into a plurality of smaller second sub-areas with each second sub-area having imprinted thereon two reference characters of a second group of reference characters with the first reference character being of a first color and the second reference character being of a second color different from the first color;

a first plurality of marker representing a plurality of players of each team;

a separate marker representing a baseball; and random selection means comprising the second group of reference characters for determining various plays of the game.

3. A game for playing the game of baseball by teams comprising:

a board having a substantially square area defined thereon representing a baseball field, said area being divided into a plurality of first square sub-areas each represented by a different single digit imprinted thereon, and each of said first sub-areas being divided into a plurality of smaller second sub-areas, the second sub-areas having imprinted thereon a two digit number with each digit being a numeral between "1" and "6" and the first digit of each number being of a first color and the second digit being of a second color different from the first color, the board having an area representative of an infield of the baseball field, said infield area being within one of the first sub-areas;

plurality of markers representing a plurality of players of each team;

a marker representing a baseball; and a plurality of six sided dice of various colors for determining the various plays of the game.

4. The game of claim 3 in which the board further comprises a listing of different types of pitches along one edge of the baseball field and a group of two digit numbers under each of the types of pitches, each of said digits being between numerals "1" and "6" and the first of all the two digit numbers being of the same color and the second digit of all the two digit numbers being of a color different from that of the first digit.

5. The game of claim 4 in which the board further comprises a plurality of groups of batting numbers along another edge of the baseball field, each of the batting numbers being of two digits with each digit being between "1" and 37 6" and the first digit of each number being of the same color and the second digit of each number being of a different color from that of the first digits.

6. The game of claim 5 in which the board further comprises a list of fielding two digit numbers arranged in a plurality of rows with a single digit being at the beginning of each row, the number of rows being equal to the number of larger squares into which the baseball field is divided, each of the digits of the two digit numbers being from "1" to "6" with the first digit of all the two digit numbers being of the same color and the second digit of all the two digit numbers being of a different color from that of the first digit.

7. The game of claim 6 in which the colors of the dice correspond with the colors of the digits on the board.

8. The game of claim 7 in which the board is divided into nine first sub-areas arranged in rows and columns and imprinted with numerals "1" to "9⇄, respectively, and each of the first sub-areas is divided into thirty six second sub-areas.

9. The game of claim 8 in which the two digit number in the second sub-areas of each of the first sub-areas correspond with every combination of the numbers on two of the dice and are randomly arranged in the second, sub-areas.

10. The game of claim 9 in which the field has foul lines extending along two sides from a common corner and the first sub-areas extending along the foul lines extend beyond their respective foul line so that one row of the second sub-areas of each first sub-areas is outside the foul lines to represent a foul ball area.

11. The game of claim 10 in which the board further comprises at least one additional row of small squares extending along the foul ball area second sub-areas, each of the additional squares having imprinted thereon a two digit number with the digits being between "1" and "6" and the rows of additional squares having the numeral "0" at one end thereof.

12. The game of claim 11 in which the group of numbers under each type of pitch comprises sixteen different two digit numbers with some of the numbers having the same first digit and the other of the numbers having different first digits.

13. The game of claim 12 in which in each of the groups of pitching numbers four of the numbers have the same first digit, four of the numbers have the same first digit which is different from the first digit of the other four numbers, and the remaining numbers have different first digits.

14. The game of claim 13 in which each group of batting numbers comprises twelve different two digit numbers.

15. The game of claim 14 in which each group of batting numbers comprises four additional two digit numbers with the additional numbers having a heading indicating a good or designated hitter.

16. The game of claim 15 in which the fielding numbers are arranged in ten rows with the single digit at the beginning of each row being from numerals "0" to "9" and there being thirty four different two digit numbers.

17. The game of claim 16 in which two of the rows contain six two digit numbers, three of the rows contain four two digit numbers and the other rows each contain two of the two digit numbers.

18. The game of claim 17 in which the infield of the baseball field is in a first of the first square sub-areas at a corner of the junction of the two foul lines.

* * * * *